US007243073B2

(12) United States Patent
Yeh et al.

(10) Patent No.: US 7,243,073 B2
(45) Date of Patent: Jul. 10, 2007

(54) METHOD FOR REALIZING VIRTUAL MULTI-CHANNEL OUTPUT BY SPECTRUM ANALYSIS

(75) Inventors: Ta-Jung Yeh, Taipei (TW); Wen-Lung Tseng, Taipei (TW); Ching-Jung Chu, Taipei (TW)

(73) Assignee: VIA Technologies, Inc., Taipei (TW)

( * ) Notice: Subject to any disclaimer, the term of this patent is extended or adjusted under 35 U.S.C. 154(b) by 917 days.

(21) Appl. No.: 10/639,434

(22) Filed: Aug. 13, 2003

(65) Prior Publication Data

US 2004/0037425 A1 Feb. 26, 2004

(30) Foreign Application Priority Data

Aug. 23, 2002 (TW) ..... 91119183 A

(51) Int. Cl.
*G10L 19/00* (2006.01)
*H04R 5/00* (2006.01)

(52) U.S. Cl. ..... 704/500; 381/10

(58) Field of Classification Search ..... 704/500; 381/10
See application file for complete search history.

(56) References Cited

U.S. PATENT DOCUMENTS 5,970,152 A * 10/1999 Klayman ..... 381/1
6,449,371 B1 * 9/2002 Tan et al. ..... 381/119

* cited by examiner

*Primary Examiner*—Susan McFadden
(74) *Attorney, Agent, or Firm*—Bacon & Thomas, PLLC

(57) ABSTRACT

A method for realizing virtual multi-channel by spectrum analysis is disclosed. The low-frequency-effect sound data is obtained by averaging sound data of left and right channels in the two-channel sound source and filtering the average by a first low pass filter. The central channel sound data is obtained by averaging sound data of the left and the right channels in the two-channel sound source and filtering the average by a second low pass filter. The surround right and left sound data is obtained by copying sound data of the left and the right channels in the two-channel sound source, respectively.

7 Claims, 3 Drawing Sheets

METHOD FOR REALIZING VIRTUAL MULTI-CHANNEL OUTPUT BY SPECTRUM ANALYSIS

BACKGROUND OF THE INVENTION

1. Field of the Invention

The present invention relates to a method for realizing virtual multi-channel output and, more particularly, to a method for converting a two-channel output into six-channel output on a personal computer by spectrum analysis.

2. Description of Related Art

Over the several decades, there has been a considerable growth in computer technology. As a result, more functions are incorporated into a computer. For example, a multi-channel output is made possible on a computer. A data format of a six-channel sound source is illustrated in FIG. 1. As shown, labels "L", "R", "C", "LFE", "S.L", and "S.R" represent sound sources of left channel, right channel, central channel, low-frequency-effect channel, surround left channel, and surround right channel respectively. A six-channel output from a computer is made possible by running a program in which a decoding of data of six-channel sound source by means of a decoder is performed.

A data format of a two-channel sound source is illustrated in FIG. 2 in which characters "L" and "R" represent left and right channels respectively. Also, it is possible of converting the data format shown in FIG. 2 into that shown in FIG. 1, as illustrated in FIG. 3. As shown, 0s are written into "C", "LFE", "S.L", and "S.R" fields while "L" and "R" fields are maintained the same as that of the two-channel sound source. This means that the central channel, the low-frequency-effect channel, the left surround channel, and the right surround channel of the computer are mute with only the left and right channels being enabled. In other words, channels other than the left and front right channels are wasted in a computer having a six-channel configuration if the sound source consists of only the left and right channels. This is not desirable.

Therefore, it is desirable to provide a novel method of realizing multi-channel output from a computer by spectrum analysis so as to mitigate and/or obviate the aforementioned problems.

SUMMARY OF THE INVENTION

An object of the present invention is to provide a method for realizing virtual multi-channel output by spectrum analysis, which is capable of generating six-channel output effect with only a two-channel sound source.

To achieve the object, the present invention provides a method for realizing virtual multi-channel by spectrum analysis capable of converting two-channel sound source into six-channel output. The method comprises: a step of generating low-frequency-effect sound data for averaging sound data of left and right channels in the two-channel sound source and filtering the average by a first low pass filter to obtain low-frequency-effect data, wherein the sound data having a frequency higher than a first cut-off frequency is filtered by the first low pass filter; a step of generating central channel sound data for averaging sound data of the left and the right channels in the two-channel sound source and filtering the average by a second low pass filter to obtain central channel sound data, wherein the sound data having a frequency higher than a second cut-off frequency is filtered by the second low pass filter; a step of generating surround right and left sound data for copying sound data of the left and the right channels in the two-channel sound source as the surround right and left sound data, respectively; and a step of assembling six-channel sound data for assembling the low-frequency-effect sound data, the central channel sound data, the surround left sound data, the surround right sound data, the left channel sound data, and the right channel sound data.

Other objects, advantages, and novel features of the invention will become more apparent from the detailed description when taken in conjunction with the accompanying drawings.

DETAILED DESCRIPTION OF THE PREFERRED EMBODIMENT

Figure 2:
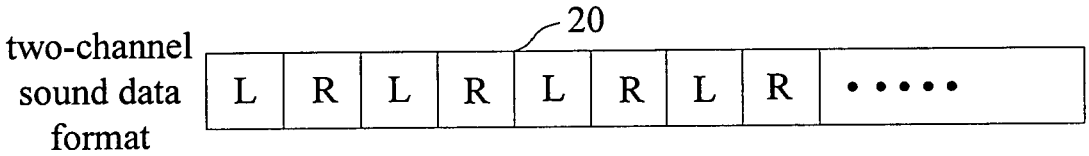
FIG. 2 PRIOR ART
FIG. 2 is a diagram of data format of a conventional two-channel sound source.
Figure 3:
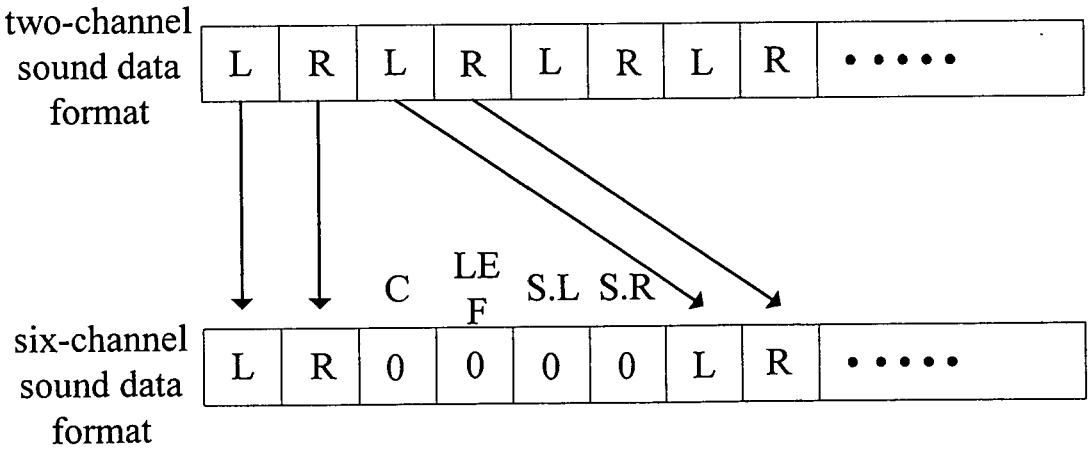
FIG. 3 is a diagram illustrating a conversion of the data format shown in FIG. 2 into that shown in FIG. 1.
Figure 4:
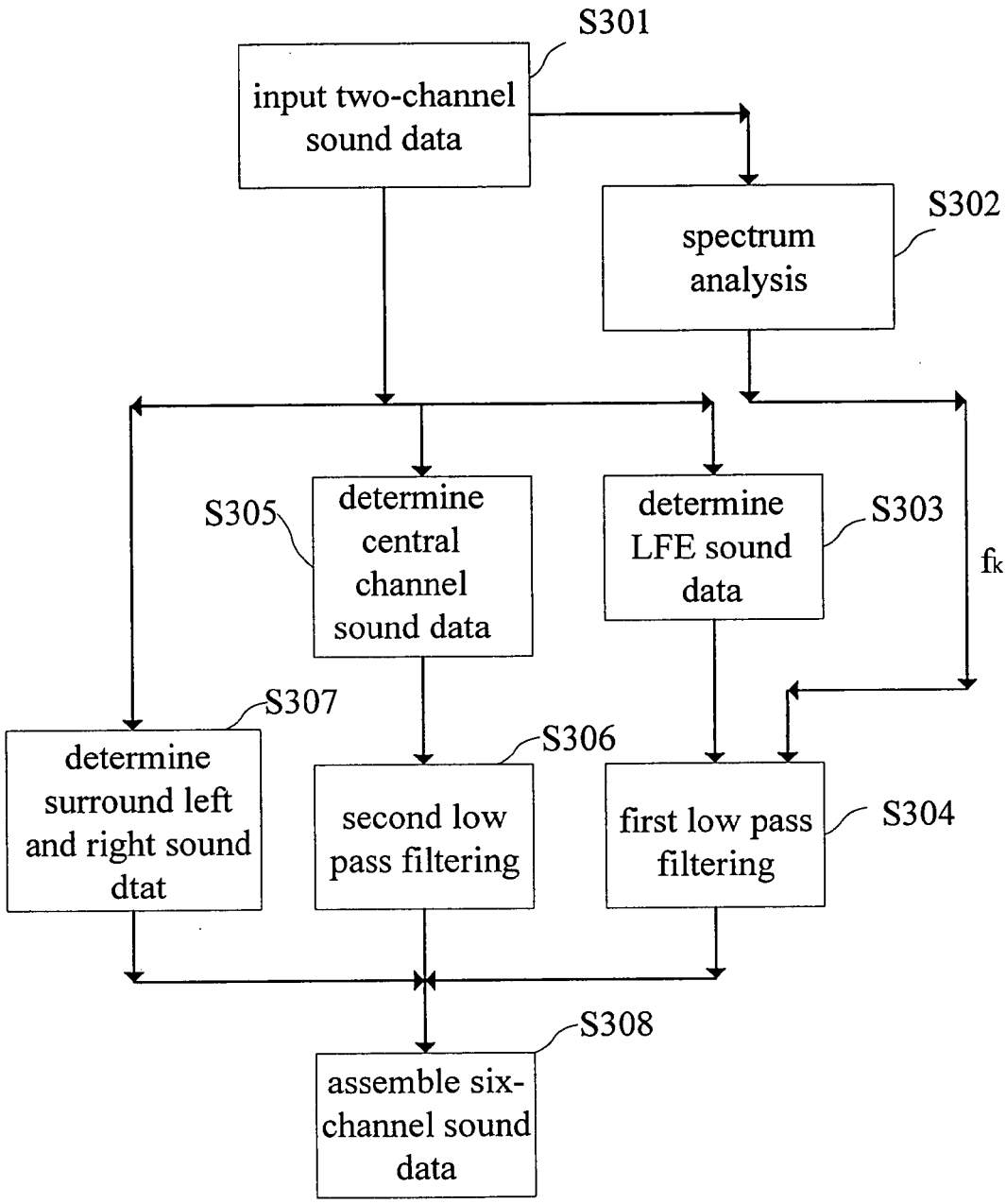
FIG. 4 is a flow chart illustrating a process of realizing multi-channel output by spectrum analysis according to the invention.
Figure 5:
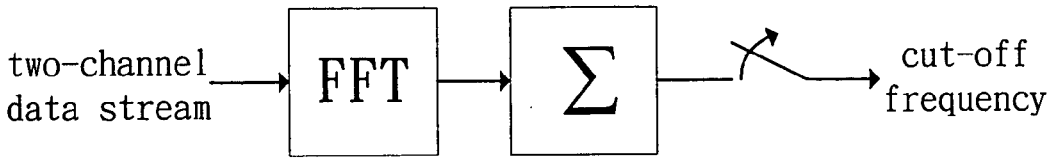
FIG. 5 is a diagram schematically depicting a determination of cut-off frequency by means of spectrum analysis according to the invention.
Figure 6:
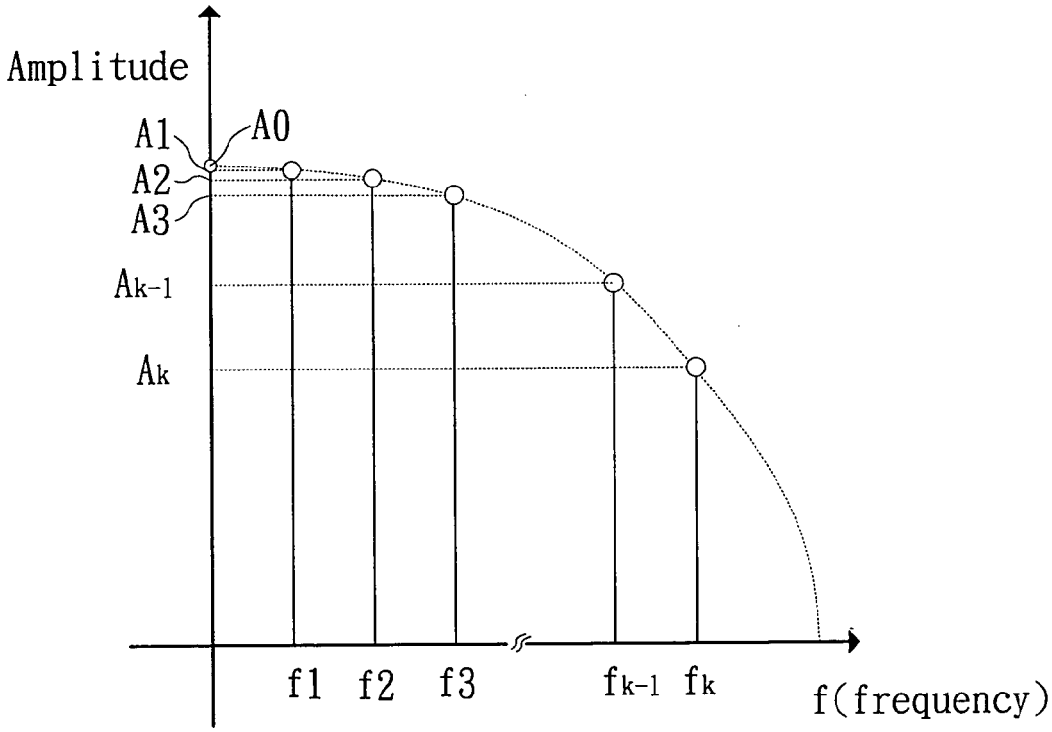
FIG. 6 plots the distribution of the power spectrum density in the frequency domain.

With reference to FIG. 4, there is shown a process of realizing multi-channel output by spectrum analysis in accordance with the invention. In step S301, data of two-channel sound source is inputted. A data format of the two-channel sound source is the same as that shown in FIG. 2. In step S302, a cut-off frequency in power spectrum density (PSD) of the data of two-channel sound source is determined. In detail, with reference to FIG. 5, a Fast Fourier Transform (FFT) is performed on a data stream of the two-channel sound source for obtaining a plurality of frequencies. The transformed frequencies are added from lower ones to higher ones within a frequency domain as best illustrated in FIG. 6. As shown, A1 is an amplitude of frequency $f_l$. A predetermined threshold $T_h$ is assumed. The addition is stopped if the sum (e.g., a summation of $A_k$, k is a non-negative integer) is equal to or larger than the predetermined threshold $T_h$. The sum of frequencies (e.g., a summation of $f_k$, k is a non-negative integer) is taken as a cut-off frequency.

In step S303, data of an unfiltered low-frequency-effect LFE' is obtained by averaging data of left and right channels L and R in the two-channel sound source (i.e., LFE'=(L+R)/2). In step S304, data of the low-frequency-effect LFE' is filtered by means of a first low pass filter having a cut-off frequency the same as that obtained in step S302. Hence, frequencies in data of the low-frequency-effect LFE' higher than the cut-off frequency is filtered out for obtaining a filtered data of the low-frequency-effect LFE.

In step S305, data of central channel C' is obtained by averaging data of left and right channels L and R in the two-channel sound source (i.e., C'=(L+R)/2). In step S306, data of the central channel C' is filtered by means of a second low pass filter having a cut-off frequency about 3 KHz. Hence, frequencies in data of the central channel C' higher than the cut-off frequency is filtered out for obtaining a filtered data of the central channel C.

Figure 1:
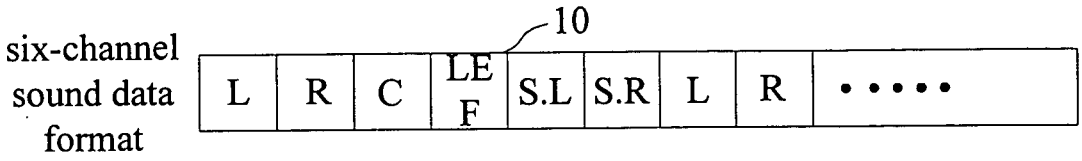
FIG. 1 PRIOR ART
FIG. 1 is a diagram of data format of a conventional six-channel sound source.

In step S307, data of surround left S.L and data of surround right S.R are obtained by copying data of left and right channels L and R in the two-channel sound source respectively (i.e., S.L=L and S.R=R). In step S308, data of the low-frequency-effect LFE, data of the central channel C, data of the surround left S.L, data of the surround right S.R, data of the left channel L, and data of the right channel R are assembled to obtain data of a six-channel sound source having a format the same as that shown in FIG. 1.

In this embodiment, steps 302 performs a spectrum analysis to determine the cut-off frequency of the first low pass filter employed in step S304. Alternatively, it is applicable to generate a plurality of frequencies by spectrum analysis in advance, so as to allow a user to choose a desired one of the frequencies via a graphic user interface (GUI) as the cut-off frequency for use in step S304. Preferably, the plurality of possible cut-off frequencies are 100 Hz, 170 Hz, 330 Hz, 600 Hz, and 1 KHz.

In view of the foregoing, it is known that, by utilizing the invention, a user can listen a six-channel output from a two-channel sound source. This can fully utilize the existing hardware of computer.

Although the present invention has been explained in relation to its preferred embodiment, it is to be understood that many other possible modifications and variations can be made without departing from the spirit and scope of the invention as hereinafter claimed.

What is claimed is:

1. A method for realizing virtual multi-channel by spectrum analysis capable of converting two-channel sound source into six-channel output, said method comprising steps of:

generating low-frequency-effect sound data for averaging sound data of left and right channels in said two-channel sound source and filtering said average by a first low pass filter to obtain low-frequency-effect data, wherein said sound data having a frequency higher than a first cut-off frequency is filtered by said first low pass filter;

generating central channel sound data for averaging sound data of said left and said right channels in said two-channel sound source and filtering said average by a second low pass filter to obtain central channel sound data, wherein said sound data having a frequency higher than a second cut-off frequency is filtered by said second low pass filter;

generating surround right and left sound data for copying sound data of said left and said right channels in said two-channel sound source as said surround right and left sound data, respectively; and assembling six-channel sound data for assembling said low-frequency-effect sound data, said central channel sound data, said surround left sound data, said surround right sound data, said left channel sound data, and said right channel sound data.

2. The method as claimed in claim 1, wherein in said step of generating low-frequency-effect sound data, said first cut-off frequency is corresponding to a frequency position in a predetermined portion of said power spectrum density (PSD) of sound data of said two-channel sound source.

3. The method as claimed in claim 1, wherein said first cut-off frequency is obtained by:

a sound source conversion step for performing a Fast Fourier Transform (FFT) on sound data of said two-channel sound source to generate converted frequencies;

a spectrum height summation step for summing frequency heights of said converted frequencies in frequency domain; and a cut-off frequency selection step for selecting said summed frequency as said first cut-off frequency when said summed frequency is more than a predetermined threshold.

4. The method as claimed in claim 3, wherein said spectrum height summation step is done by from adding said frequency having a lower value to said frequency having a higher value.

5. The method as claimed in claim 1, wherein, in said step of generating low-frequency-effect sound data, said first cut-off frequency is obtained by selecting one of a plurality of predetermined frequencies.

6. The method as claimed in claim 5, wherein said predetermined frequencies are 100 Hz, 170 Hz, 330 Hz, 600 Hz, and 1 KHz.

7. The method as claimed in claim 1, wherein, in said step of generating central channel sound data, said second cut-off frequency is about 3 KHz.

* * * * *